US008544129B2

(12) United States Patent
Won

(10) Patent No.: US 8,544,129 B2
(45) Date of Patent: Oct. 1, 2013

(54) COMPOSITE GIRDER FOR BRIDGE CONSTRUCTION

(75) Inventor: Yong-seock Won, Seoul (KR)

(73) Assignee: Hyedong Bridge Co., Ltd., Seoul (KR)

( * ) Notice: Subject to any disclaimer, the term of this patent is extended or adjusted under 35 U.S.C. 154(b) by 0 days.

(21) Appl. No.: 13/808,582

(22) PCT Filed: Apr. 1, 2011

(86) PCT No.: PCT/KR2011/002297

§ 371 (c)(1),
(2), (4) Date: Jan. 5, 2013

(87) PCT Pub. No.: WO2012/008677

PCT Pub. Date: Jan. 19, 2012

(65) Prior Publication Data

US 2013/0104320 A1 May 2, 2013

(30) Foreign Application Priority Data

Jul. 15, 2010 (KR) ..... 10-2010-0068192

(51) Int. Cl.
*E01D 2/00* (2006.01)

(52) U.S. Cl.
USPC ..... 14/24; 52/81.6

(58) Field of Classification Search
USPC ..... 52/80.1, 81.6, 88, 382; 14/2, 24, 14/74.5
See application file for complete search history.

(56) References Cited

U.S. PATENT DOCUMENTS

| | | | | | |
|---|---|---|---|---|---|
| 3,397,497 | A * | 8/1968 | Shea et al. | 52/334 |
| 4,400,917 | A * | 8/1983 | Massaro et al. | 52/86 |
| 4,601,138 | A * | 7/1986 | Hampton | 52/86 |
| 5,261,137 | A * | 11/1993 | Barkdull, Jr. | 14/77.1 |
| 5,425,152 | A * | 6/1995 | Teron | 14/24 |
| 5,590,433 | A * | 1/1997 | Fricke | 14/24 |
| 6,898,903 | B1 * | 5/2005 | Thomas | 52/86 |
| 7,114,305 | B2 * | 10/2006 | Heierli | 52/745.08 |
| 7,562,497 | B2 * | 7/2009 | Warren | 52/86 |
| 7,861,346 | B2 * | 1/2011 | Wilson | 14/24 |

FOREIGN PATENT DOCUMENTS

| | | | |
|---|---|---|---|
| JP | 8068014 | A | 3/1996 |
| JP | 2005155080 | A | 6/2005 |
| KR | 20090115481 | A | 11/2009 |

* cited by examiner

*Primary Examiner* — Gary Hartmann
(74) *Attorney, Agent, or Firm* — Novick, Kim & Lee, PLLC; Jae Youn Kim

(57) ABSTRACT

The present invention pertains to a composite girder for bridge construction. More preferably, a girder is formed in a rectangular shape that is horizontally long and opened at the top portion thereof, wherein the girder is convexly curved in the center so as to be formed in the shape of an arch. The girder has a compression section, a web and a tension section, which are integrally composed together, and is filled with concrete inside the girder so as to increase the sectional strength of the girder. Simultaneously, a stopper is formed on the inside surface of the compression section to prevent the separation of the steel materials and the concrete.

1 Claim, 8 Drawing Sheets

COMPOSITE GIRDER FOR BRIDGE CONSTRUCTION

TECHNICAL FIELD

The present invention pertains to a composite girder for bridge construction. More preferably, a girder is formed in a rectangular shape that is horizontally long and opened at the top portion thereof, wherein the girder is convexly curved in the center so as to be formed in the shape of an arch. The girder has a compression section, a web and a tension section, which are integrally composed together; and is filled with concrete inside the girder so as to increase the sectional strength of the girder. Therefore, it is possible to reinforce a support that receives a great shearing stress even without the use of any rebar. Simultaneously, a stopper is formed on the inside surface of the compression section to prevent the separation of the steel materials and the concrete. Therefore, compared with the existing girders, the composite girder of the present invention may be mounted over a noticeably long span. In addition, it is possible to reduce manufacturing costs by minimizing the use of expensive steel reinforcement materials, exhibiting sufficient strength characteristics in spite of a small dead load.

BACKGROUND ART

In general, a steel box girder, a tubular girder, an I-beam girder and the like are used as steel girders applied to bridges. Among these girders, the steel box girder is best in terms of strength and weight.

The steel box girder is a girder for a mold construction method, which can be constructed up to a maximum span of 70 m. The steel box girder is applicable to curved bridges due to high torsional strength, and has a simple process, a short construction period and excellent strength. On the other hand, since a large number of reinforcement materials should be used inside the steel box girder so as to improve strength, the construction costs of the steel box girder increase, and the weight of the steel box girder increases. Further, the steel box girder is weak against vibration and droop due to characteristics of steel materials.

The structure of the steel box girder will be described with reference to FIG. 1. A rectangular box-shaped steel box girder 10 including upper and lower flanges 11 and 12 has a structure in which a plurality of steel reinforcement materials 13 are arranged inside the steel box girder 10 along lateral and longitudinal directions and inner circumference, and the outside of the steel box girder 10 is reinforced with a cross beam 14. The steel box girder 10 is mounted on a bridge pier 1 so as to support a slab 2 that is an upper structure.

As shown in FIG. 2, a tubular girder 20 has a structure in which a plurality of steel reinforcement materials 23 are arranged inside a 'U'-shaped girder main body 21 along lateral and longitudinal directions and inner circumference, and the outside of the tubular girder 20 is reinforced with a cross beam 24. The tubular girder 20 is mounted on a bridge pier 1 so as to support a slab 2 that is an upper structure.

As shown in FIG. 3, an I-beam girder 30 has a structure in which side walls of an I-beam 31 are reinforced with a plurality of cross beams 34. The I-beam girder 30 is mounted on a bridge pier 1 so as to support a slab 2 that is an upper structure.

In addition to these girders, a PF beam girder is used. The PF beam girder is a steel composite girder that introduces prestress to a concrete portion by reloading a preflexion load, in additional consideration of 10 to 20% of allowable stress of the steel box girder, and then filling the girder with high strength concrete. The PF beam girder is disadvantageous to be applied to curved bridges, and has the problem of a dead load. Hence, the PF beam girder is frequently used in straight bridges up to a maximum span of 50 m or places requiring a low girder height, such as a downtown area and a river. Since the PF beam girder has a low girder height, it is easy to secure a girder under space, and it is advantageous to plan bridge construction. On the other hand, the construction costs of the PF beam girder increase, and it is difficult to mend and reinforce the PF beam girder in the occurrence of cracks.

Problems of the conventional girders described above will be specifically described as follows. That is, the steel box girder and the tubular girder have large scale and large weight, and use expensive steel materials exhibiting strength characteristics as a tension member for a compression member at an upper portion of the girder, which is inefficient. When considering characteristics of steel materials having weakness in terms of compression strength, an excessive number of steel reinforcement materials should be used to secure the compression strength of the upper portion of the girder, and the torsional strength is weak. Therefore, the weight of steel is increased by 40% or more, and an increase in construction cost is caused. Further, it is difficult to apply the steel box girder and the tubular girder as girders having a maximum long span of 70 m or more due to excessive weight of steel as compared with the strength of steel materials.

In the I-beam girder, the girder height (main girder height) should be increased to secure strength, and the structure of the I-beam girder may be unstable due to the weakness of torsional strength. The I-beam girder is efficient because of its sectional characteristics, but it is difficult to apply the I-beam girder as a girder having a long span.

Particularly, in the existing girders, a large number of steel reinforcement materials should be used so that a web connecting between compression and tension sections of the girder provide a great shearing stress. Therefore, the dead load of a structure increases, and economic efficiency is deteriorated due to the excessive use of construction materials.

DISCLOSURE OF INVENTION

Technical Problem

The present invention is conceived to solve the aforementioned problems. Accordingly, an object of the present invention is to provide an arch composite girder for bridge construction, which is mounted over a noticeably long span, so that it is possible to reduce manufacturing costs by minimizing the use of expensive steel reinforcement members, exhibiting sufficient strength characteristics in spite of a small dead load.

That is, concrete, instead of steel materials, is reinforced at the support (bridge pier) where a great shearing stress is applied to the girder in which the bonding boundary surface between a compression section and a web is upwardly convexly curved to be centrally symmetric through the entire length of the girder, thereby improving strength characteristics.

Another object of the present invention is to provide a composite girder for bridge construction, in which a stopper is formed on the inner surface of a compression section formed in a rectangular shape having an opened top portion, so that concrete filled in the rectangular compression section is not separated from the compression section in the girder but integrally composed with the compression section.

Still another object of the present invention is to provide a composite girder for bridge composition, in which a steel plate is mounted at a sectional portion connecting compression sections of the girder, and concrete is filled in the compression sections, so that the girder can be precisely assembled in the air on the spot, thereby smoothly transferring an axial force.

Still another object of the present invention is to provide a composite girder for bridge construction, in which when a tension section of the girder receives compression, the width of the tension section is decreased, and the thickness of the tension section is increased, thereby effectively satisfying the section necessary for the compression.

Technical Solution

The constitution of the present invention for achieving the object will be described with respect to the accompanying drawings.

According to an aspect of the present invention, there is provided a composite girder for bridge construction, comprising:

a compression section 110 formed by being filled with concrete 130 up to bottom surfaces of stoppers 140 respectively formed on both inner surfaces of the compression section so that the concrete 130 filled in the girder 100, which is formed long in the horizontal direction while maintaining a rectangular section having an opened top portion, is not separated from steel materials while being ascended by an external force such as vibration.

a steel web 121 vertically formed beneath the compression section 110; and a steel tension section formed perpendicular to the steel web, wherein the width of the steel tension section is decreased and the thickness of the steel tension section is increased in a positive moment section, and a changing section 170 of the width forms a gentle inclination with a ratio of 2:1 or more, wherein a connecting portion of the compression section 110 and the vertical web 121 is upwardly convexly curved in the center while the compression section 110, the web 121 and the tension section 122 are formed long in the horizontal direction, wherein the girder 100 is mounted between a bridge abutment 300 and a bridge pier 310, and a support is filled with concrete 200 to reinforce shearing stress, wherein the concrete filled in the support is consecutively connected with the filled concrete convexly formed in the center inside the compression section 110 so that only the minimum placement is allowed, wherein the concrete 130 is filled in the compression member in the positive moment section, and wherein the concretes 130 and 200 are filled, and a cover plate 150 is formed at the top of the compression section in a negative moment section.

ADVANTAGEOUS EFFECTS

According to the present invention configured as described above, the composite girder for bridge construction implements an optimized structure which can efficiently overcoming compression and tension stresses respectively applied to upper and lower portions of the girder having a upwardly convexly curved shape in the center of the entire length by integrally composing a compression section, a steel web and a steel tension section. In the compression section, steel materials and concrete are integrally composed by filling the concrete in the girder formed long in the horizontal direction while maintaining a rectangular shape. The web is vertically formed beneath the compression section, and the tension section is horizontally formed beneath the web. Thus, the sectional strength of the girder is improved, so that compared with the existing girders, the composite girder of the present invention can be mounted over a noticeably long span. In addition, it is possible to reduce manufacturing costs by minimizing the use of expensive steel reinforcement materials, exhibiting sufficient strength characteristics in spite of a small dead load.

Further, since the stopper is formed along the inner surface of the compression section of the girder, the concrete is filled in the compression section to have a constant height, and the concrete filled in the compression section is not separated from the girder by the stopper, in spite of expansion and contraction or a load applied to the compression section, thereby maintaining strength characteristics.

In addition, since a steel plate is formed on the section of the connecting portion connecting the compression sections of the girder, the concrete is densely filled in the compression member. Thus, the bonding surfaces of the connecting portions can be easily assembled while maintaining continuity in the air, thereby maintaining strength characteristics.

Further, the center of the girder formed long by filling the concrete in the compression section of the girder is formed into a convexly arch structure, so that the concrete filled in the compression section resists a certain compression stress in the bridge axis direction. Hence, there is no change in axial force, and thus a small number of front-end connecting materials are required. In addition, the shearing stress is hardly applied to the web, and thus the front-end reinforcement can be minimized.

Further, when the center of the girder formed long by filling the concrete in the compression section of the girder is formed into a convexly arch structure, the flange horizontally placed on the boundary between the concrete of the compression section and the web is formed into the same arch structure, so that it is possible to increase resistance against the load in the direction perpendicular to the bridge axis, i.e., the longitudinal direction, as well as the bridge axis direction. Thus, it is possible to remarkably reduce the phenomenon that both end portions about the web are drooped when the concrete is filled in the compression section and when the load is applied to the upper portion of the girder. Accordingly, although thin steel materials are used, it is possible to exhibit sufficient strength characteristics.

Further, a bracing is formed on horizontal plane above the compression section of the girder so as to resist torsion, together with the concrete filled in the compression section. Thus, a minimum number of steel materials can be used, so that it is possible to achieve an optimized design for a bridge having torsional stress, such as a curved bridge.

MODE FOR INVENTION

A composite girder for bridge construction according to a preferred embodiment of the present invention will be described in detail with reference to the accompanying drawings.

The present invention has a structure in which steel materials and concrete used in a bridge, a building or the like are integrally formed to increase resistance against warping, a tension section (lower flange) of the girder, which receives a tensioning force, uses steel materials so as to economically improve capability of resisting warping, and a compression section (upper flange) of the girder, which receives a compressing force, uses concrete having excellent compression strength as compared with its price.

The present invention provides specific structures of the girder. In the girder receiving a uniformly distributed a load, the compression section in which steel materials and concrete are integrally composed together is formed, so that it is possible to minimize shearing stress between a web and the compression section, thereby removing or reducing the use of any rebar in the longitudinal direction of the concrete. Further, it is possible to remarkably reduce the use of any shear connector and steel reinforcement member of the web, thereby achieving economic design of the girder.

According to the structure of the composite girder of the present invention, the compression section composed with concrete receives a certain force in the length direction with respect to not only a slab constructed above the composite girder but also the dead load of the composite girder, so that the entire weight can be remarkably reduced. Further, the concrete is maintained in a three-axis compression state for X-, Y- and Z-axis directions by a steel portion outside the concrete having the function of a mold, thereby improving compression strength and structural efficiency.

Accordingly, the present invention provides the structure of a girder which can maximally use characteristics of concrete having a strong compressive force, in spite of a weak tensioning force and shearing stress, so that it is possible to implement a composite girder having excellent strength and economic advantages.

In order to have such advantages, the composite girder for bridge construction according to the present invention comprises a compression section 110 formed into a structure in which steel materials and concrete are composed together, a web 121 vertically formed beneath the compression section 110, and a tension section 122 horizontally formed beneath the web 121.

FIGS. 4 to 9 illustrate an arch reinforcing composite girder for bridge construction according to an embodiment of the present invention (hereinafter, will be described based on a case where positive moment is applied).

Figure 1:
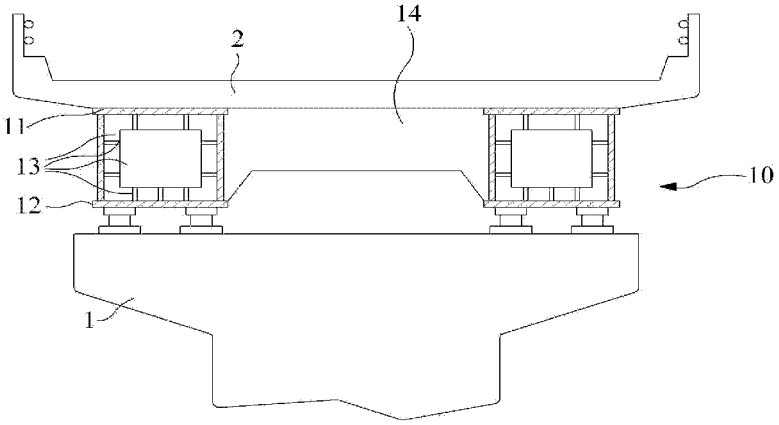
fig. 1 PRIOR ART
FIG. 1 is a schematic cross-sectional view illustrating a conventional steel box girder.
Figure 2:
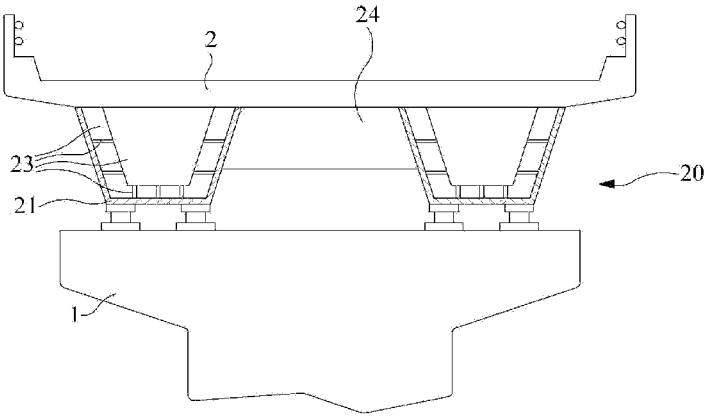
fig. 2 PRIOR ART
FIG. 2 is a schematic cross-sectional view illustrating a conventional tubular girder.
Figure 3:
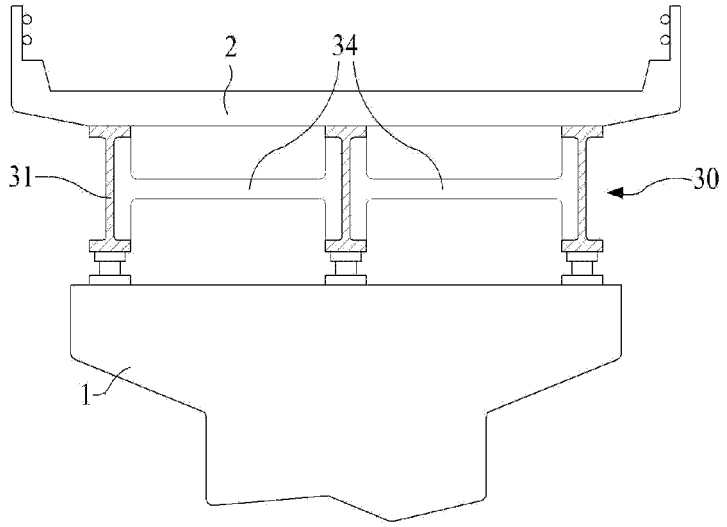
fig. 3 PRIOR ART
FIG. 3 is a schematic cross-sectional view illustrating a conventional I-beam girder.
Figure 4:
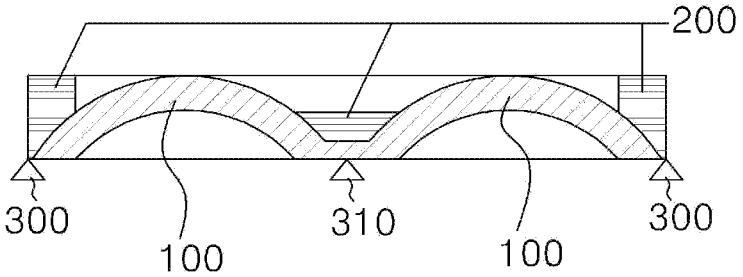
FIG. 4 is a sectional view illustrating a state in which concrete is reinforced at a support of an arch girder in which the concrete is filled in a compression section according to the present invention.
Figure 5:
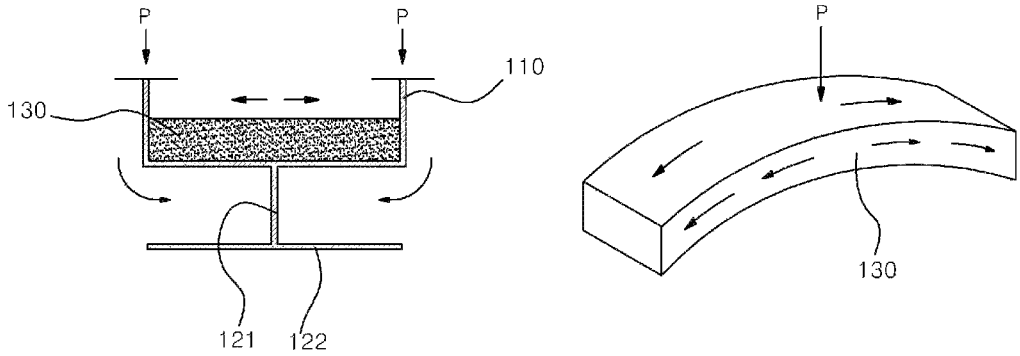
FIG. 5 illustrates sectional and perspective views of the arch girder in which concrete is filled in the compression section according to the present invention.

As shown in FIGS. 4 and 5, the girder 100 according to this embodiment is a steel structure formed long in the horizontal direction while maintaining a rectangular section with an opened top portion. In the girder, concrete 130 is filled in the compression section so that the steel materials and the concrete are integrally composed together.

The steel web 121 integrally formed over the entire length of the compression section 110 is formed vertically to the compression section 110 beneath the compression section 110. The steel tension section 122 integrally formed over the entire length of the web 121 is formed perpendicular to the web 121.

In this embodiment, the compression section 110, the web 121 and the tension section 122 have a structure uniformly formed long in the horizontal direction over the entire length while maintaining a constant ratio of height to width without any change in height.

The compression section 110 may be a longitudinal steel box having a longitudinal width relatively greater than a lateral width or a lateral steel box having a lateral width relatively greater than a longitudinal width. Accordingly, the compression section 110 can be variously selected and applied by changing the ratio of lateral and longitudinal widths of its sectional shape according to design conditions such as span and environment on the spot. The internal concrete 130 is protected from the external air by the compression section 110 formed with the steel box, so that it is possible to prevent deterioration (superannuation) of the compression section, thereby improving durability.

The compression section 110 has strength superior to the structure of a general steel box, and the concrete 130 is placed as close as to the compression section 110, so that it is possible to efficiently overcome deformation such as torsion or droop.

When the composite girders of the present invention are consecutively mounted between a bridge abutment 300 and a bridge pier 310 and between the bridge pier 310 and a bridge abutment 300 as shown in FIG. 4, a great shearing stress is applied to the bridge abutment 300 and the bridge pier 310, which are starting and ending supports of the arch. Therefore, the supports are reinforced with concretes 130 and 200 for cost reduction and simple construction, rather than steel materials used as the conventional reinforcement member, thereby improving strength characteristics.

Figure 4A:
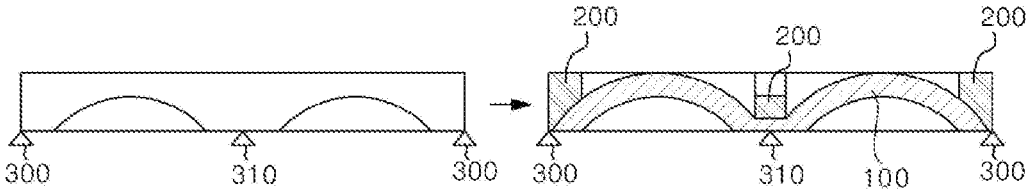
FIGS. 4A and 4B are sectional views illustrating a construction method for reinforcing concrete at the support of the arch girder according to the present invention.
Figure 4B:
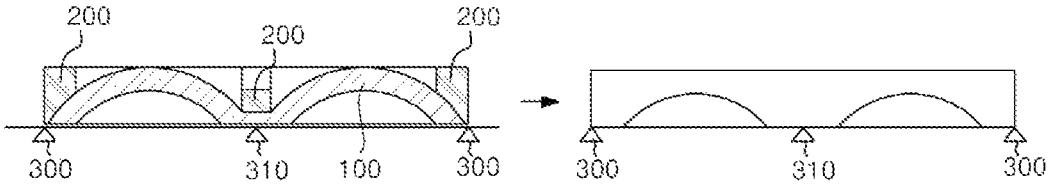

In order to reinforce the supports, there are a method of mounting the girder between the bridge abutment 300 and the bridge pier 310 and then filling the concrete 130 and 200 as shown in FIG. 4A, and a method of mounting the girder having the concrete 130 and 200 previously filled therein between the bridge abutment 300 and the bridge pier 310 as shown in FIG. 4B. A minimum number of reinforcement members are required in the method of mounting the girder between the bridge abutment 300 and the bridge pier 310 and then filling the concrete. However, no reinforcement member is required in the method mounting the girder having the concrete previously cast therein between the bridge abutment 300 and the bridge pier 310.

As shown in FIG. 5, the girder 100 formed with the compression section 110, the web 121 and the tension section 122, in which the concrete 130 is filled, is formed in an arch having a curved or parabolic shape. Hence, the longitudinal stress in the concrete 130 is minimized by providing the load of the concrete in the longitudinal direction, i.e., the axis direction of the girder 100, so that tension rebar is not installed or is minimally installed in the concrete 130.

Figure 6:
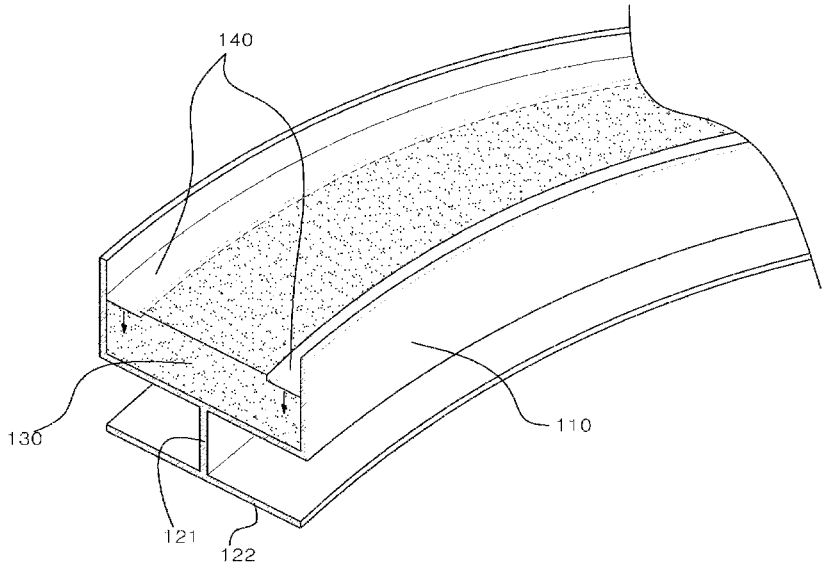
FIG. 6 is a perspective view illustrating a state in which a stopper is mounted on the inner surface of the compression section according to the present invention.

As shown in FIG. 6, stoppers 140 are respectively formed along both inner surfaces of the compression section 110 so as to fill the concrete 130 in the compression section 110 to have a uniform height on the inner surface of the compression section 110, to prevent the concrete 130 filled in the compression section 110 from being separated from the steel materials by the load of tension and compression of the compression section 110 forcibly formed after construction, and to increase coherence between the concrete and the steel materials.

Since the concrete 130 is filled along the height of the stopper 140, the concrete can be filled to have a constant height.

That is, the concrete 130 filled beneath the stopper 140 formed in the length direction along both the inner surfaces of the girder 10 may be separated toward the upper portion of the girder 100 by movement, particularly vibration or the like. In this case, the stopper 140 allows the concrete 130 to be adhered closely to the top surface thereof. Hence, the stopper prevents the separation of the concrete 130, and has the function of a horizontal reinforcement member for preventing deformation such as distortion of a vertical member in the compression section 110 of the girder 100.

The girder 100 according to the present invention can secure continuity of reinforcement caused by the concrete as compared with the existing reinforcement structure implemented by only steel reinforcement materials. Further, the composite reinforcement of the girder is implemented using the concrete having price relatively cheaper than that of the steel materials, so that it is possible to reduce construction cost and to form a stronger support structure.

In this case, the filling of the concrete 130, the standard of the stoppers 140 and the interval between the stoppers 140 may be variously applied according to design conditions such as span and environment on the spot.

Figure 7:
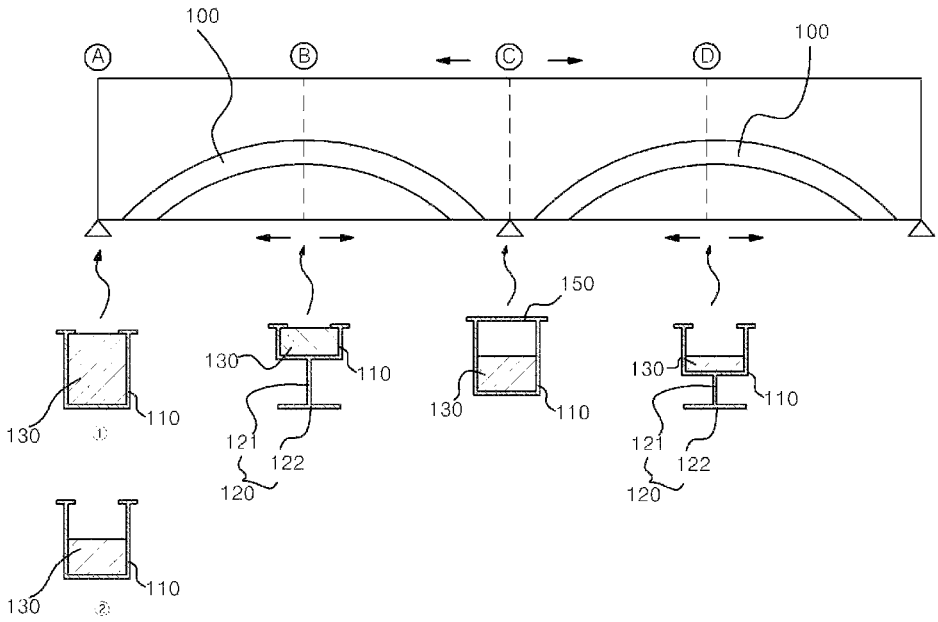
FIG. 7 is a sectional view illustrating a state in which a cover plate is mounted at a portion of the compression section, to which negative moment is applied, by continuously mounting the girder according to the present invention.

In addition, if the arch girders 100 having the concrete 130 filled therein are consecutively mounted between the bridge abutments 300 and the bridge piers 310, shearing stress is applied to lower portions of the middle portions B and D of the arch girder 100 and an upper portion of the middle support C of the arch girder 100 as shown in FIG. 7. In this case, it is necessary to perform separate reinforcement on the middle support B (negative moment section) having the shearing stress applied to the upper portion thereof.

Therefore, in order to perform the separate reinforcement, the concrete 130 is filled in the compression section 110 of the girder 100 in the positive moment section, and the concretes 130 and 200 are filled in the bridge pier at the support to which the negative moment is applied. Simultaneously, a cover plate 150 is mounted at the top of the compression section 110, so that it is possible to efficiently overcome tension.

As shown in the compression section 110 reinforcing the support of FIG. 7, the height of the concrete 130 and 200 filled in the compression section 110 is changed depending on design conditions of the composite girder. That is, if a large amount of load is applied to the girder at portion A of FIG. 7, the concrete is fully filled in the compression section 110. If a small amount of load is applied to the girder at portion C of FIG. 7, the concrete is cast into the compression section as much as the amount of the load.

Figure 8A:
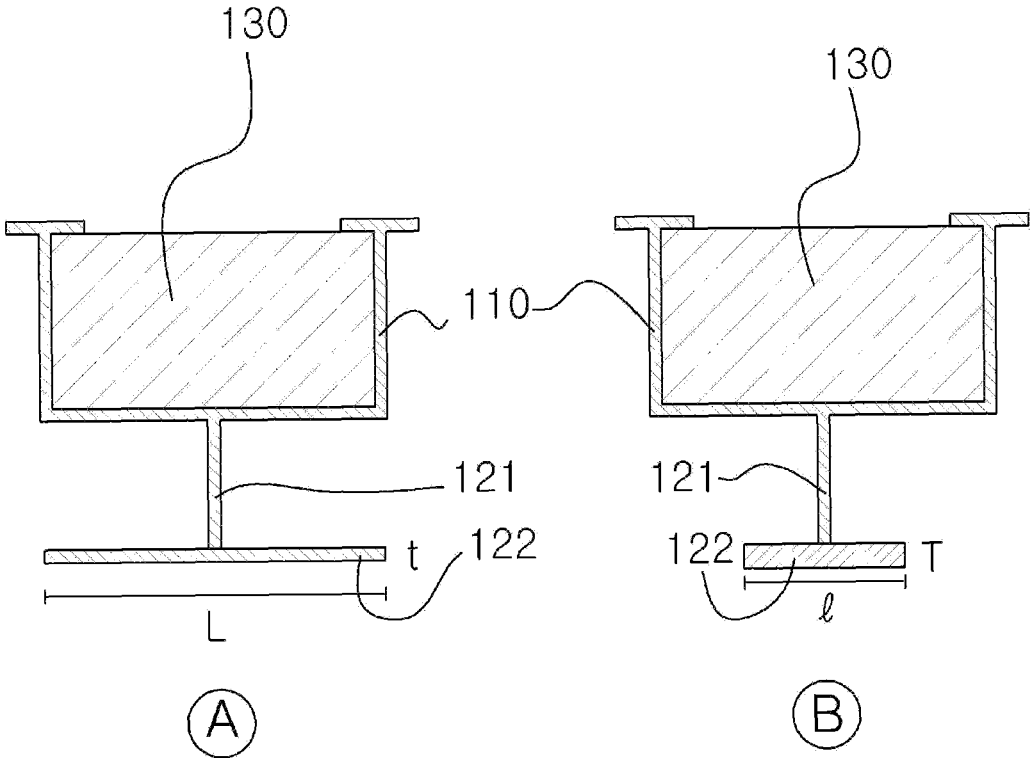
FIGS. 8A and 8B are sectional views illustrating an embodiment of a tension section according to the present invention.
Figure 8B:
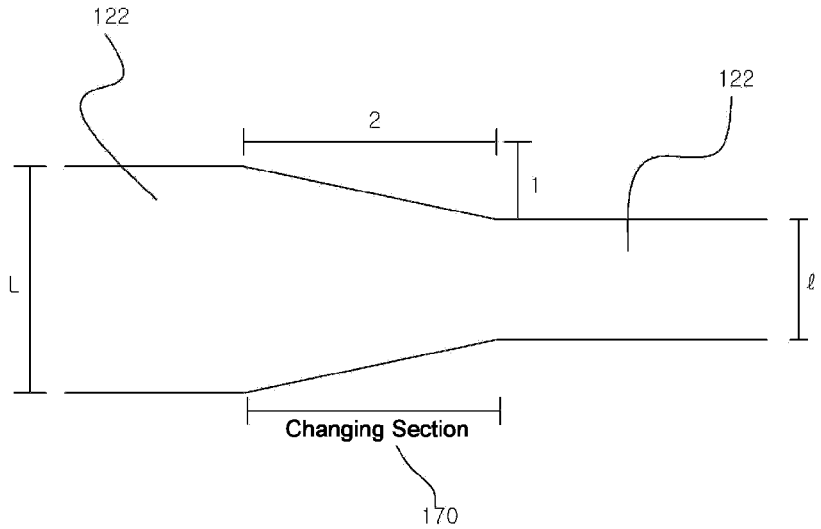

In another embodiment of the present invention, as shown in FIGS. 8A and 8B, when the tension section 122 receives tension, the width of the tension section 122 can be maintained by performing structural calculation as shown in these figures. However, when the tension section 122 receives compression, the tension section 122 necessarily maintains a structure capable of satisfying the section necessary for the compression. Therefore, the width of the tension section 122 is not decreased, but the thickness of the tension section 122 is increased, thereby implementing the structure capable of overcoming the compression.

As shown in FIG. 8B, a changing section 170 is formed in the tension section 122 for the purpose of continuity when the width of the tension section 122 is narrowed along the length direction of the tension section 122. The inclined plane of the changing section 170 forms a gentle inclination in which the ratio of length to width is 2:1 or more, thereby maintaining the entire strength.

Figure 9A:
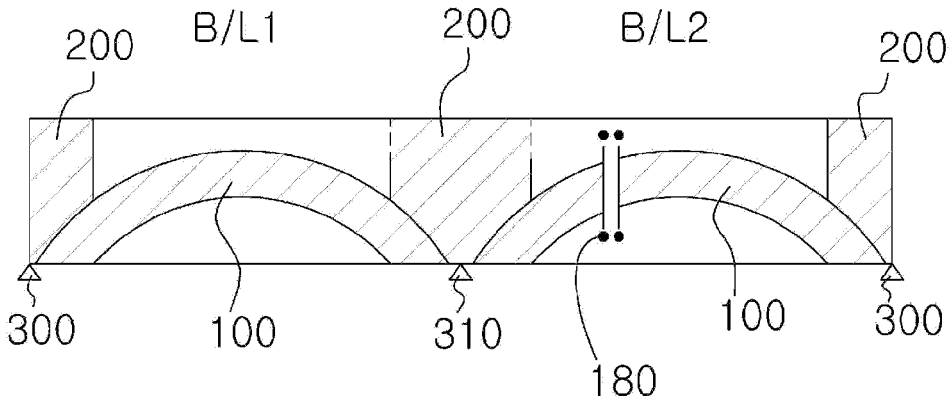
FIGS. 9A and 9B are sectional and perspective views illustrating a connecting portion of the girder filled with concrete according to the present invention.
Figure 9B:
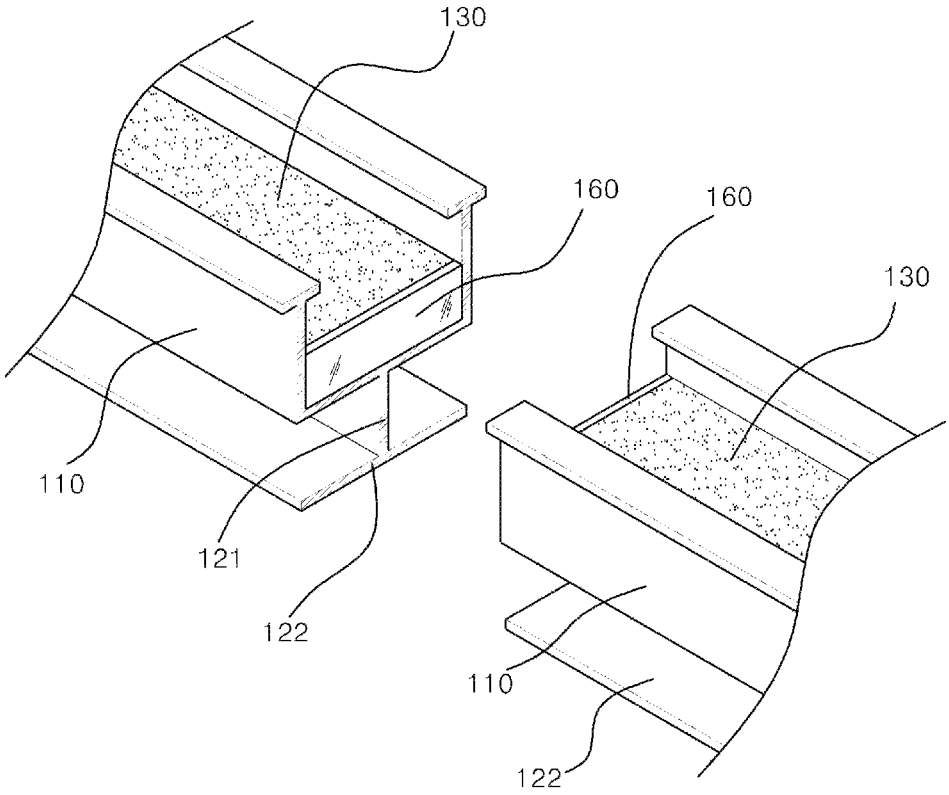

In still another embodiment of the present invention, the mounting process of manufacturing the arch girders 100 in which the concrete 130 is filled in the compression section on the ground and mounting the arch girders 100 on the spot as shown in FIGS. 9A and 9B will be described.

That is, when the girder 100 manufactured on the ground is consecutively mounted between the bridge abutment 300 and the bridge pier 310, connecting portions 180 connect the girder 100 at the support to which the maximum shearing stress is applied and a portion at which minimum stress occurs, instead of the peak of the arch, to which the maximum moment is applied. In this case, a steel plate 160 is mounted on the end surface of the connecting portion 180 so that the concretes 130 can be adhered closely to each other, thereby maintaining strength characteristics.

The concrete 130 is filled in the compression section 110. In this case, the steel plate 160 is mounted to the connecting portion 180 of the compression section 110. Hence, although the concrete 130 is cast into the compression section 110, the connecting portion 180 is precisely formed so that the concretes 130 can be adhered closely to each other. Thus, although the girder 100 in which the concrete 130 is filled in the compression section 110 is connected in the air, the bonding surfaces of the connecting portions 180 have a uniform height and area. Accordingly, the connecting portions 180 can be precisely assembled with each other, thereby maintain strength characteristics for securing the continuity of axial force.

More preferably, the connecting portions are temporarily assembled with each other on the ground and then constructed in the air so as to previously secure mutual adhesion in the assembling of the connecting portions in the air.

That is, the steel plate 160 is mounted to the connecting portion 180 in order to prevent a space from being formed between the connecting portions 180 when the previously manufactured girder 110 is connected in the air and to prevent loss of the arch effect.

In this case, the steel plate 160 is preferably formed to having the minimum thickness so as to induce the close adhesion between the bonding surfaces of the connecting portions 180. The steel plates 160 may be respectively mounted at both sides of the connecting portion 180 connecting the upper flange of the girder 100. Alternatively, the steel plate 160 may be mounted at only one side of the connecting portion 180 when necessary.

Figure 10:
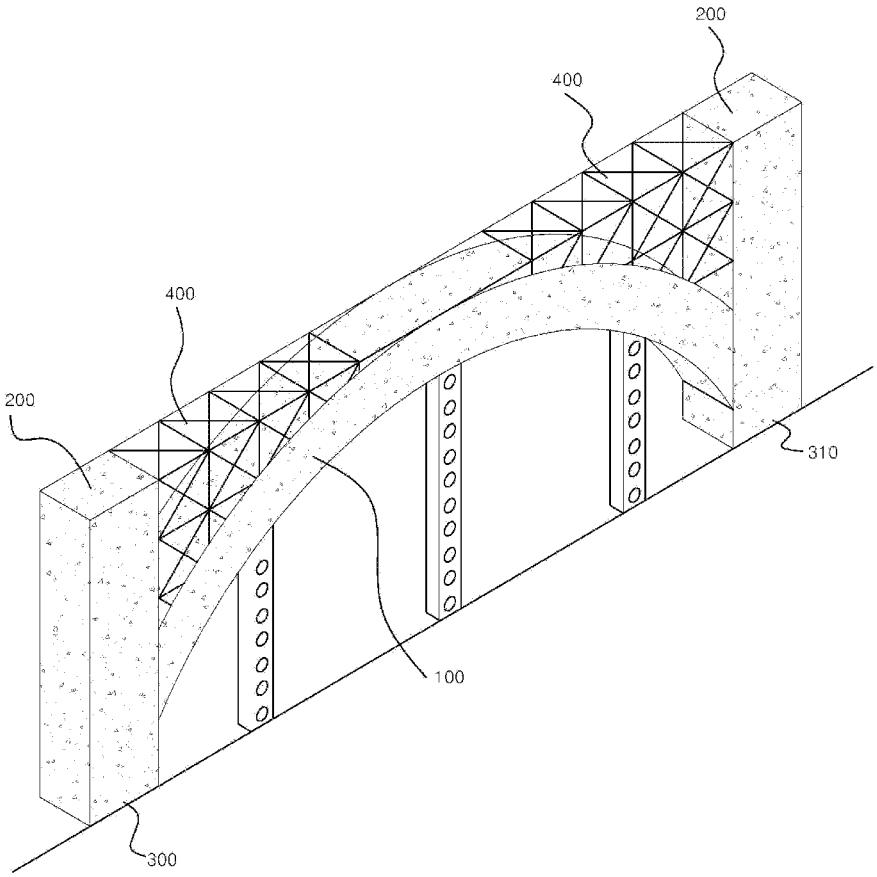
FIG. 10 is a perspective view illustrating a state in which a bracing is mounted to reinforce torsion of the girder according to the present invention.

In another reinforcement method of the present invention, when the girder 100 in which the concrete 130 is filled in the compression part 110 is mounted to the bridge abutment 300 or the bridge pier 310 as shown in FIG. 10, the upper horizontal plane of the space portion 190 formed on the top surface of the arch concrete 130 is reinforced with a bracing 400 so as to prevent torsion.

Figure 11:
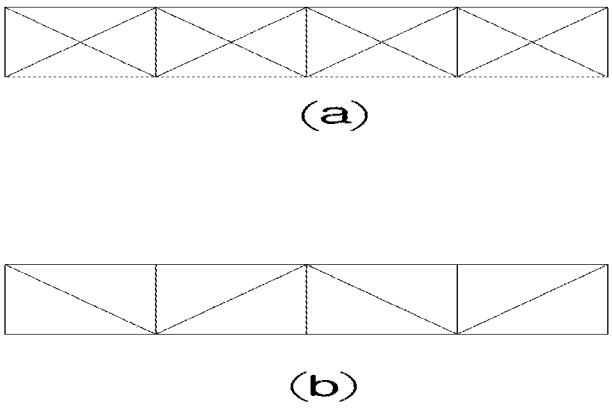
FIG. 11 is a front view illustrating several embodiments of the bracing according to the present invention.

The bracing 400 is manufactured into an X-shaped structure 410 shown in FIG. 11 (*a*) or a W-shaped structure 420 shown in FIG. 11 (*b*), using steel. The bracing 400 having the X-shaped or W-shaped structure 410 or 420 may be selectively constructed, corresponding to the torsion of the girder 100. In addition, the bracing 400 may be manufactured into other shapes so as to obtain the same effect.

The invention claimed is:

1. A composite girder for bridge construction, the composite girder comprising:

a compression section including a first unit of concrete, steel materials, a connecting portion, a cover plate and an open top portion, wherein the compression section is formed up to bottom surfaces of stoppers respectively formed on left and right inner surfaces of the compression section and is formed longitudinally in a horizontal direction, and wherein the first unit of compression section has a rectangular section;

a steel web vertically formed beneath the compression section; and a steel tension section formed perpendicular to the steel web and including a changing section, wherein a width of the steel tension section is decreased and a thickness of the steel tension section is increased in a longitudinal direction, and a width of the changing section 170 forms a gentle inclination with a ratio of 2:1 or more, wherein the connecting portion of the compression section and the vertical steel web are upwardly convexly curved in the center thereof, and the steel web and the tension section are formed longitudinally in the horizontal direction, wherein the girder is mounted between a bridge abutment and a bridge pier, and at least one support including a second unit of concrete and being connected to the first unit of concrete is configured to reinforce shearing stress, wherein the second unit of concrete filled in the at least one support is consecutively connected with the first unit of concrete convexly formed in the center inside the compression section, and wherein the cover plate 150 is disposed at a top of the compression section.

* * * * *